US008199075B2

(12) United States Patent
Marx et al.

(10) Patent No.: US 8,199,075 B2
(45) Date of Patent: Jun. 12, 2012

(54) METHOD FOR DRIVING, AND A CIRCUIT OF AN ELEMENT OF AN ILLUMINATED DISPLAY

(75) Inventors: Thilo Marx, Villingen-Schwenningen (DE); Heinrich Schemmann, Villingen-Schwenningen (DE); Thomas Schwanenberger, St. Georgen (DE)

(73) Assignee: Thomson Licensing, Issy les Moulineaux (FR)

( * ) Notice: Subject to any disclaimer, the term of this patent is extended or adjusted under 35 U.S.C. 154(b) by 1004 days.

(21) Appl. No.: 11/629,048

(22) PCT Filed: May 23, 2005

(86) PCT No.: PCT/EP2005/052342

§ 371 (c)(1),
(2), (4) Date: Dec. 8, 2006

(87) PCT Pub. No.: WO2005/122120

PCT Pub. Date: Dec. 22, 2005

(65) Prior Publication Data

US 2008/0284688 A1 Nov. 20, 2008

(30) Foreign Application Priority Data

Jun. 11, 2004 (DE) ..... 10 2004 028 233

(51) Int. Cl.
*G09G 3/30* (2006.01)

(52) U.S. Cl. ..... 345/76; 345/77

(58) Field of Classification Search ..... 345/76–83
See application file for complete search history.

(56) References Cited

U.S. PATENT DOCUMENTS 5,734,361 A * 3/1998 Suzuki et al. ..... 345/74.1
(Continued)

FOREIGN PATENT DOCUMENTS

EP 1227466 A2 * 7/2002
(Continued)

OTHER PUBLICATIONS

Search Report Dated Mar. 7, 2006.

*Primary Examiner* — Nitin Patel
*Assistant Examiner* — Dorothy Harris
(74) *Attorney, Agent, or Firm* — Robert D. Shedd; Jeffrey M. Navon

(57) ABSTRACT

In illuminated displays with lighting elements which are driven by means of a control voltage, the voltage drop on a supply line, which supplies two or more lighting elements, is compensated for. The currents for all of the light elements, which are connected to a supply line, and the known resistances are used to calculate the potential profile of the supply line for this purpose. The control voltages for the light elements are changed such that the actual potential on the supply line for each element is taken into account. Fluctuations in the brightness of the illuminated display resulting from potential differences are avoided. One element of an illuminated display has a current control means, a signal retaining means, a light emitting means and means for interrupting the current flow through the light emitting means. The control voltage is adjusted with the current flow interrupted, so that no potential differences exist on the supply line. The signal retaining means hold the control voltage relative to the potential on the line at the respective position of the lighting element. An illuminated display has adjustable voltages for the supply lines. The voltages are chosen to be sufficiently high that the minimum required voltage for setting the desired currents through the lighting elements is achieved.

11 Claims, 3 Drawing Sheets

U.S. PATENT DOCUMENTS

| | | | | |
|---|---|---|---|---|
| 6,121,942 | A * | 9/2000 | Sanou et al. | 345/75.1 |
| 6,229,506 | B1 * | 5/2001 | Dawson et al. | 345/82 |
| 6,400,348 | B1 | 6/2002 | Young | |
| 6,870,522 | B2 * | 3/2005 | Sagano et al. | 345/75.2 |
| 7,071,635 | B2 * | 7/2006 | Inoue et al. | 315/366 |
| 7,145,533 | B2 * | 12/2006 | Imamura | 345/81 |
| 7,336,272 | B2 * | 2/2008 | Okamoto | 345/211 |
| 7,724,245 | B2 * | 5/2010 | Miyazawa | 345/204 |
| 2001/0024186 | A1 * | 9/2001 | Kane et al. | 345/98 |
| 2002/0089473 | A1 * | 7/2002 | Yamazaki et al. | 345/75.2 |
| 2002/0089479 | A1 * | 7/2002 | Sato et al. | 345/87 |
| 2003/0062524 | A1 | 4/2003 | Kimura | |
| 2003/0063110 | A1 | 4/2003 | Sagano et al. | |
| 2003/0107542 | A1 * | 6/2003 | Abe et al. | 345/89 |
| 2003/0201955 | A1 * | 10/2003 | Song et al. | 345/76 |
| 2004/0001039 | A1 * | 1/2004 | Shino et al. | 345/100 |
| 2004/0145547 | A1 * | 7/2004 | Oh | 345/76 |
| 2004/0174354 | A1 * | 9/2004 | Ono et al. | 345/204 |
| 2004/0252089 | A1 * | 12/2004 | Ono et al. | 345/82 |
| 2005/0088103 | A1 * | 4/2005 | Kageyama et al. | 315/169.3 |
| 2005/0219236 | A1 * | 10/2005 | Sano et al. | 345/211 |
| 2006/0145969 | A1 | 7/2006 | Fish et al. | |
| 2006/0231740 | A1 * | 10/2006 | Kasai | 250/214.1 |

FOREIGN PATENT DOCUMENTS

| | | |
|---|---|---|
| EP | 1288902 | 3/2003 |
| WO | WO9848403 | 10/1998 |
| WO | WO 2004/023446 | 3/2004 |
| WO | WO2004034461 A1 | 4/2004 |

* cited by examiner

METHOD FOR DRIVING, AND A CIRCUIT OF AN ELEMENT OF AN ILLUMINATED DISPLAY

This application claims the benefit, under 35 U.S.C. §365 of International Application PCT/EP2005/052342, filed May 23, 2005, which was published in accordance with PCT Article 21(2) on Dec. 22, 2005 in English and which claims the benefit of German application No. 102004028233.1, filed Jun. 11, 2004.

The invention relates to a method for driving elements of an illuminated display, and to a circuit for elements of an illuminated display. The invention also relates to an illuminated display having two or more elements according to the invention.

Illuminated displays which produce light by means of light emitting means through which current flows have a large number of light emitting means arranged in a suitable form. The light emitting means in this case emit a light flux which is dependent on the electric current flowing through them. The expression light flux describes the total radiated power of the light source. In the following text, the expression current is used to represent the electric current. The light emitting means are combined with further circuit elements to form elements. The further circuit elements include, inter alia, switching means and current control means. Desired currents through the light emitting means are set by the switching means and the current control means. In the case of an illuminated display having two or more elements in a matrix arrangement, monochrome or polychrome images are displayed, by means of a number of pixels. In the case of monochrome images, the images are rastered into individual grey levels for the pixels. The grey levels are in this case different light flux values. One element in each case typically corresponds to one pixel, although it is also feasible for two or more elements to be combined to form one pixel. The various light flux values are produced by different currents through the light emitting means. In the case of a polychrome illuminated display, two or more monochrome elements of different colours normally interact, and form one pixel. Colours different from the original colours of the light emitting means in the elements can be displayed by additive colour mixing for each pixel. The light emitting means include, inter alia, light-emitting diodes. Light-emitting diodes can be produced on the basis of semiconductor materials (for example silicon, germanium), although light-emitting diodes are also available based on organic materials (OLED: "Organic Light Emitting Diode"). All of these light-emitting diodes have the common feature that the emitted light flux depends on the electric current through the light emitting means.

In the known light emitting means, a direct current is passed through the light emitting means in order to produce light. The light emitting means is in this case connected in the forward direction. The current control means is normally connected in series with the light emitting means. In a first way of driving the elements, the current control means is driven by a control potential which is referred to a reference ground potential. The control potential which is applied to the control electrode of the current control means causes current to flow through the current control means and through the light emitting means. The characteristics of the light emitting means and of the current control means are in this case unambiguous, so that a specific potential results in a specific electric current, and a specific electric current results in a specific light flux. The expressions potential and voltage are used synonymously in the following text, unless a different meaning is expressly stated.

Field-effect transistors (FETs) are preferably used as the current control means. These transistors are distinguished by voltage control. Apart from changing the charge on parasitic capacitances in the event of a change in the control voltage and resistive losses, the drive consumes virtually no power. The control potential is in this case applied between the gate electrode and the source electrode of the FET. The magnitude of the control voltage determines the current flow through the transistor, which can also be regarded as a controllable resistance. Bipolar transistors are also used as the current control means in other embodiments of control circuits.

An element 3 for a voltage drive is shown in FIG. 1. A current control means 4 is connected in series with a light emitting means 8 between an operating voltage VDD and ground. The operating voltage is applied to the element 3 via a supply line 20. A control signal is supplied to a control input of the current control means 4 via a switch 10. In this case, the control signal is a control voltage $U_{set}$. The switch 10 is in this case controlled such that only one individual element 3 in an arrangement of elements is in each case driven. It is thus possible to connect two or more elements 3 to one control line. With the drive that is required for this circuit, the time period during which the light-emitting diode emits light is relatively short. Depending on how many elements 3 of the illuminated display are connected to a common control line, the active time period is reduced. Since the human eye represents a natural system with a low-pass filter behaviour, it is possible to compensate for the short active time period by appropriately increasing the light flux during the active time period.

Illuminated displays are also feasible in which each current control means 4 is permanently driven by a control signal $U_{set}$. There is then no need for the switch 10. The large number of control lines required reduces the available area of the illuminated display for the light to emerge from, however.

In the case of the element illustrated in FIG. 2, a signal retaining means 6 has been added to the circuit described above, between the control electrode of the current control means 4 and the supply line 20. The signal retaining means 6 keeps the control signal $U_{set}$ that is applied when the switch 10 is closed constant when the switch 10 is opened until a new control signal $U_{set}$ is applied. It is thus possible to extend the active time period during which the element 8 emits light. The active time period now covers virtually the entire period until a new image is formed. In consequence, the required light flux which must be emitted during the active time period is reduced. Since the observer's eye can now integrate a reduced light flux over a longer time period, the same amount of light is perceived, and this results in the same image impression as that described with reference to FIG. 1. Since ageing and changes to the electrooptical characteristics of OLEDs are highly dependent on the current density of the electric current through the OLEDs, this circuit offers the advantage that the characteristics change more slowly.

In illuminated displays that comprise elements, which are arranged in a matrix arrangement and have individual current control means, the individual elements are arranged in rows and columns. Two or more elements are connected to a common supply line. Depending on the nature of the elements, the common supply line is connected to a supply voltage or to a reference potential, for example ground.

Supply lines and control lines as well as the light emitting means share the available image area in illuminated displays having two or more elements. In order to make it possible to emit as much light as possible, the control and supply lines are designed to be thin. In this case, thin means that the cross section of the line is as small as possible. Furthermore, the lines may be composed of a transparent conductive material. These materials are often less conductive than a conventional conductor material. Irrespective of the particular embodiment, the control and supply lines have finite impedances. In particular, the ohmic line resistance means that the potential on the supply line may be different for different elements, depending on the set current which is passed through the elements that are connected to the supply line.

A specific control potential applied to the control electrodes of the current control means for the elements results, as stated further above, in a specific electric current, and thus in a specific light flux. The current control means refer the control potential applied to their control electrodes to the potential at one of their current-carrying connections. This reference potential is in this case, for example, the potential on the supply line at the location of a respective element. The control potential which is referred to the potential at one of the current-carrying connections is the relative control potential. The rated control potential which is applied by a drive circuit to the control electrodes of the current control means is, however, referred to a reference potential. The relative control potential varies with respect to the rated control potential, as a result of the different potential for different elements on the supply line. The varying relative control potential results in an electric current and thus a light flux which differs from the desired electric current or light flux.

The potential differences on the supply line also vary depending on the image content being displayed, because the respective currents through the elements vary depending on the image content. The differences between the rated control potential applied by the drive circuit and the relative control potential thus also vary.

As explained further above, the voltage drop on the supply line directly influences the control voltage for the current control means. The gate and source connections are two connections of field-effect transistors (FETs) which are used as the current control means. A control potential, the gate-source voltage, is applied between the gate and source connections. The source connection is in this case connected to the supply line, and the control potential is supplied to the gate connection.

The resistance of a supply line for one column or one row of elements is defined as follows:

$$R = \rho * \frac{L}{A} \tag{1}$$

where ρ is the resistivity of the material of the supply line, for example 3 μΩcm for aluminium. L is the length of the line section, and A is the cross-sectional area of the line. The voltage drop on a section of the supply line can be calculated as follows:

$$\Delta V = R * I_{max} \tag{2}$$

where $I_{max}$ is the maximum current through the section, for example the sum of the currents through the elements which are supplied by that section of the supply line. If a supply line in an illuminated display has a length of 200 mm, and the cross section of the line is 20 μm×200 nm, this results in a resistance of 1.5 kΩ. Assuming that there are 120 elements being supplied by the supply line, and the sum of the currents in one section is 120 μA, this results in a maximum voltage drop of 180 mV for this section. The voltage drop is thus in a range within which the threshold voltage of the FET that is used as the current control means also varies from one element to another. These fluctuations are dependent on the production methods and other factors. Even the variation of the threshold voltage results in a non-uniform brightness distribution in the illuminated display. The control voltage variation which results from voltage drops on the supply line further increases the non-uniform brightness distribution.

The illuminated display described in the above example is still relatively small, with 120 elements per supply line. In the case of larger illuminated displays, the effect is considerably exacerbated.

It is now desirable to improve the drive for illuminated displays having elements of the type described above. For this purpose, it is desirable to provide an improved element for illuminated displays. Finally, it is desirable to provide an illuminated display with elements according to the invention, and to provide a suitable drive method.

The method according to the invention provides for the voltage drop or offset to be expected on a supply line to be calculated from the known resistances between the individual elements and the nominal value of the current in the individual elements. The offset which results from the calculation is combined with the respective rated control potential of the individual elements, for example by being added, thus compensating for the difference to be expected between the rated control voltage and the actual control voltage at the control electrode of the current control means. The currents in the individual elements are known, since the image content to be displayed as well as the relationship between the brightness and current of the light emitting means are known, and are unambiguous. The calculation is carried out continuously, that is to say the offset is also recalculated whenever the image content changes. The method according to the invention typically results in individual elements or groups of elements being driven cyclically.

The relationship between the brightness, the current and the voltage of the light emitting means is also referred to in the following text as the electrooptical characteristics of the light emitting means. The relationship between the voltage and the current in the current control means is referred to in the following text as the electrical characteristics of the current control means.

In one embodiment of the method according to the invention, the addition of an offset is not carried out in an external computation circuit, but is effected by storing of the uncorrected rated control potential in a signal retaining means when the current flow through the light emitting means is interrupted. In this case, a switching means is controlled during a programming phase for all of the elements connected to a common supply line, such that no current can flow through the elements. Since no current is flowing, the potential is the same along the entire supply line. The rated control signals or rated control voltages are now applied to the current control means for the individual elements, and are stored in a signal retaining means. In this case, the rated control voltages are referred to a reference potential. The signal retaining means are connected such that they hold the signal relative to the potential at the location of the supply line at which the element is connected. The switching means are now controlled for all of the elements which are supplied by the common supply line such that a current can flow through the light emitting means. This is referred to as the start of an operating phase. The potentials on the supply line for the individual elements vary as a function of the currents and as a function of the image content, respectively. The signal retaining means hold the relative control potentials with respect to the potential at the location of the supply line at which the respective elements are connected. The relative control voltage setting for each current control means, and thus the current setting through the respective light emitting means therefore remain constant. The combination of the rated control voltage and offset related to the reference potential, according to the invention, is achieved by holding the rated control voltage with respect to the location on the supply line at which the respective element is connected. The brightness fluctuations resulting from the potential differences on the supply line are thus avoided.

A further development of the above method according to the invention provides for the supply voltage to be increased from a start value continuously or in steps once the current flow through the elements has been re-established. At the same time, the current through the supply line is measured. Any increase in the supply voltage leads to a rise in the current through the individual elements until the respective set current is reached. When the current through the supply line does not change in the steady state when the voltage is increased further, the minimum required supply voltage has been reached which allows the desired current to flow through each of the elements which are connected to the same supply line. As an alternative to this, it is possible to end the increasing of the supply voltage when the change rate in the measured current is below a predetermined value. The voltage setting is now maintained until the image information for at least one of the elements which are connected to this supply line changes.

An element of an illuminated display according to the invention which can be driven using the method described above has a light emitting means and a current control means. Furthermore, a signal retaining means and a first switching means are provided, via which switching means a control signal can be supplied to the signal retaining means. According to the invention, a second switching means is provided, which optionally passes or interrupts the current flow through the light emitting means.

A first embodiment of the illuminated display according to the invention has elements according to the invention arranged in a matrix.

In a further embodiment of the illuminated display according to the invention, the electrical and electrooptical characteristics of the current control means and of the light emitting means, respectively, of elements are known and, for example, are stored in a memory. Furthermore, the supply lines are connected individually or in groups to variable voltage supplies. If the image content is known, it is therefore possible to adjust the supply voltages such that the minimum required voltage is applied to an element on the individual line or the group of lines. In the case of image contents which vary only slightly over time but vary substantially in places, or if the image brightness varies slowly with time, it is thus possible to reduce the power requirement. One example of image contents which vary slightly over time but vary particularly substantially in places is image contents of information billboard at railway stations or airports.

In another embodiment of an illuminated display according to the invention having two or more elements, a first connection of a light emitting means in the element is connected in a known manner to a respective current control means. A second connection of all the light emitting means, which are connected to one supply line, is connected to a connecting network whose potential can be varied selectively. In this embodiment, the second switching means for interrupting the current flow during a programming phase can be omitted. During the programming phase, the potential on the connecting network is varied such that it is not possible for any current to flow through the light emitting means. In one preferred embodiment, the light emitting means are then switched to the reverse direction, for example, or the voltage across the light emitting means is set too low for any current to flow, or the connecting network is switched off. The rated control signal is held in signal retaining means, in the manner described above. Once the programming of all of the elements which are connected to the same supply line has been completed, the current is allowed to flow through the connecting network again.

In a further embodiment of an illuminated display according to the invention, the potential on the supply line is variable. During the programming phase, the potential on the supply line is, for example, connected to the reference potential, that is to say to ground. Due to the lack of voltage across the current control means and the light emitting means of the elements, which are connected to the supply line, no current can flow. The control signal is now stored in the signal retaining means. In the operating phase, the supply line is connected to a potential, which suffices for allowing the desired currents to flow in the elements. Since the signal retaining means hold the potential applied to them relative to the point to which they are connected, the selected current flows irrespective of the possible potential differences on the supply line.

The invention will be described in more detail in the following text with reference to the drawing, in which.

Identical or similar components are provided with the same reference symbols in the figures.

Figure 1:
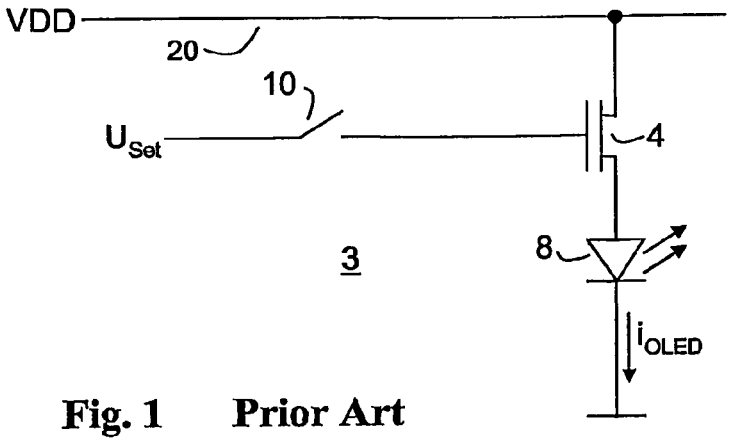
Fig. 1 Prior Art
FIG. 1 shows a known element of an illuminated display.
Figure 2:
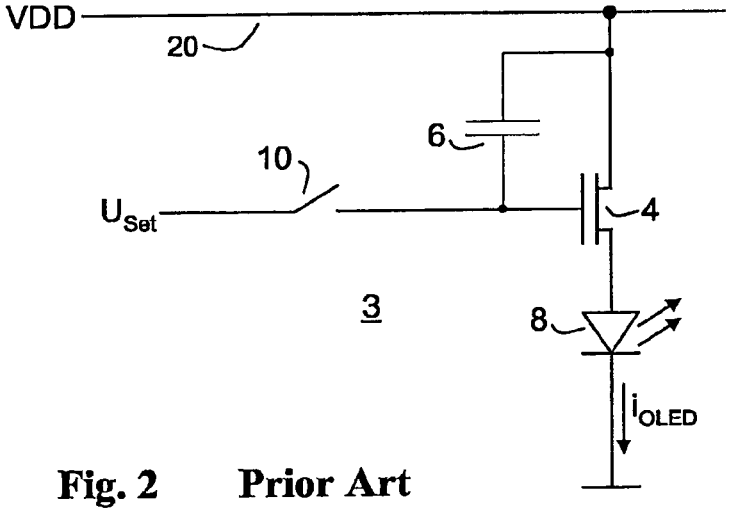
Fig. 2 Prior Art
FIG. 2 shows a further known element of an illuminated display.

FIGS. 1 and 2 have already been described further above, in the introduction to the description. They will not be described again in any more detail in the following text.

Figure 3:
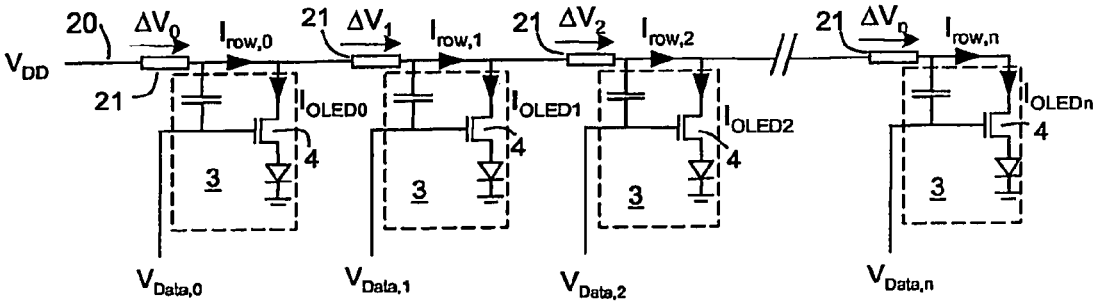
FIG. 3 shows a schematic illustration of a supply line with connected elements.

FIG. 3 shows a schematic illustration of a part of an illuminated display. The figure shows a supply line 20 with connected elements 3. In order to assist understanding, the elements 3 are surrounded by dashed lines. A voltage $\Delta V_0$, $\Delta V_1$, $\Delta V_2$, . . . , $\Delta V_n$, is in each case dropped across resistors 21, with this voltage being dependent on the current $I_{row,0}$, $I_{row,1}$, $I_{row,2}$, . . . , $I_{row,n}$ through the resistors 21. The magnitude of the currents $I_{row,0}$, $I_{row,1}$, $I_{row,2}$, . . . , $I_{row,n}$ is the sum of the currents through the respective downstream elements 3, $I_{OLED0}$, $I_{OLED1}$, $I_{OLED2}$, . . . , $I_{OLEDn}$. The resistances of the resistors 21 are known, as are the values of the currents $I_{OLED0}$, $I_{OLED1}$, $I_{OLED2}$, . . . , $I_{OLEDn}$ through the elements 3. According to the invention, the voltage drops across the individual resistors are calculated. The rated values of the control voltages $V_{Data,0}$, $V_{Data,1}$, $V_{Data,2}$, . . . , $V_{Data,n}$ (which come from a control circuit that is not illustrated) that are related to a reference voltage are in each case corrected for the calculated voltage drops $\Delta V_0$, $\Delta V_1$, $\Delta V_2$, . . . , $\Delta V_n$, in order to compensate for these voltage drops in the steady state. In the example illustrated in the figure, the respective voltage drops are calculated as follows:

$$\Delta V_0 = R * \sum_{x=0}^{n} I_{row,x} \tag{3}$$

$$\Delta V_1 = R * \left( \sum_{x=0}^{n} I_{row,x} - I_{OLED,0} \right) \tag{4}$$

$$\Delta V_2 = R * \left( \sum_{x=0}^{n} I_{row,x} - I_{OLED,0} - I_{OLED,1} \right) \tag{5}$$

...

$$\Delta V_m = R * \left( \sum_{x=0}^{n} I_{row,x} - \sum_{y=0}^{m-1} I_{OLED,y} \right) \tag{6}$$

The index n in the equations denotes the total number of elements connected to the supply line 20. The first sum in the equations represents the total current which flows into the supply line 20. Depending on the position m of the element 3 whose voltage drop is being calculated, the sum of the currents of the upstream elements 3 is subtracted from the total current. The values of the resistors 21 are assumed to be the same, for simplicity. If the resistances are different, these must be taken into account with their actual values.

The voltage on the supply line 20 at the current control means 4 for an element 3 at the location m is then calculated as follows:

$$V_m = V_{DD} - \sum_{x=0}^{m-1} \Delta V_x \tag{7}$$

The control voltage for an element 3 at the location m must be corrected by the difference between the rated supply voltage $V_{DD}$ and the voltage $V_m$ on the supply line 20 at the location m, in order to set the desired current through the respective light emitting means 8.

Figure 4:
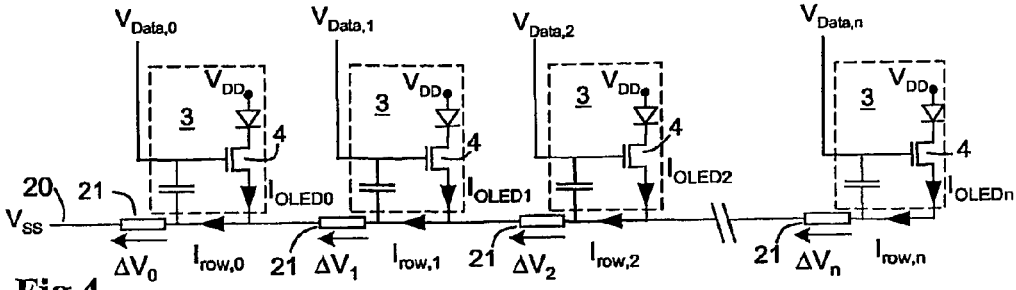
FIG. 4 shows a further schematic illustration of a supply line with connected elements.

FIG. 4 shows a similar circuit to that illustrated in FIG. 3. In contrast to the illustration in FIG. 3, the supply line 20 is in this case a ground line. The relationships explained further above between the voltage drops and the line resistances also apply in this case, however. The supply voltage VDD is, for example, supplied over an area, so that the voltage drops are negligible in this case.

In the examples, the line resistances are related to one line. The relationships also apply analogously for two supply lines, one of which carries the supply voltage and the other carries a reference potential, such as ground.

Depending on the current control means 4 that is used and on the type of transistors used, a positive or a negative control voltage is applied to the control electrode of the current control means. This also governs whether the potential difference is compensated for by addition or subtraction of the correction voltage. However, the invention can be used analogously for both situations.

Figure 5:
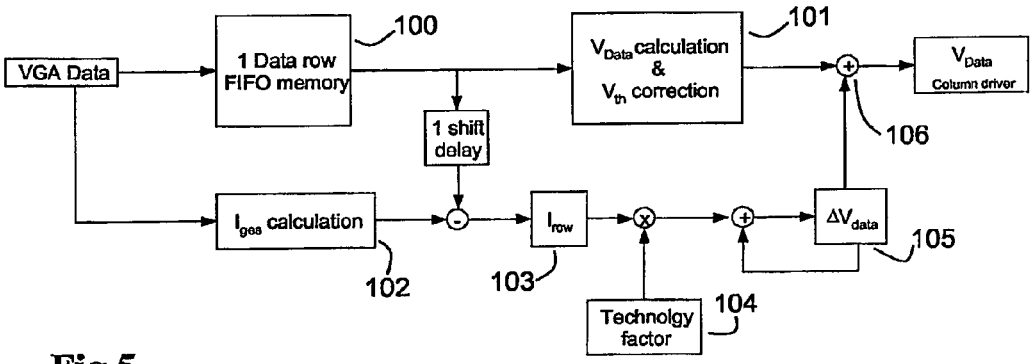
FIG. 5 shows a schematic illustration of the calculation of a corrected control signal.

FIG. 5 shows a block diagram of an example of a calculation process for the correction voltage. The illuminated display in this example is designed such that all the pixels in one row are connected to a common supply line. If the illuminated display is assumed to display the image content in rows, the data for the pixels in each row is first of all delayed by one row period in step 100. This makes it possible to determine the overall current for one row even when the data for individual pixels is transmitted sequentially, pixel by pixel. The nominal control potential is calculated in step 101. Individual or ageing-dependent fluctuations in the electrical and electrooptical characteristics of the elements 3 are also corrected for during this process. The potential difference for each pixel, that is to say for each element 3 in the row, is calculated in steps 102 to 105, and the nominal control signal is corrected accordingly in step 106. In one embodiment, the potential difference is determined by means of a technology factor 104, which represents the impedance of the line for individual elements.

The invention is not restricted to illuminated displays which have elements that are connected jointly to one supply line row-by-row. The method can also be used for displays in which elements are connected to a common supply line column-by-column. If the elements, which are connected to a common supply line, are driven in parallel, the display of the image data must be delayed until the potentials on the supply line for each element can be determined from the data for all of the elements which are connected to this supply line. The delay is then, for example, one field or frame period, depending on the chosen type of display. In the case of a field drive, the data for the respective previous field has already been calculated and can be included in the calculation.

In another embodiment of an illuminated display according to the invention, the elements in one row are connected to a common supply line. A sequential drive, element-by-element, for the illuminated display uses the known image data for the elements which have already been driven to calculate the potential profile on the supply line.

In one embodiment, those elements which have not yet been driven are switched off, that is to say no current flows through them. Those elements which have not yet been driven can be switched off, for example, via switching means in order to interrupt the current flow. The potential on the supply line for each element to be driven at that time can thus be determined by storing the values of the currents of elements which have already been driven, and by using these values to calculate the potential profile on the supply line. The control signal for the respective next element to be driven is then corrected accordingly. This method allows the memory size to be kept to a minimum. If, for example, the drive process is carried out row-by-row, the memory need only be sufficiently large to be able to store the values for the elements in a single row. Furthermore, the delay in the reproduction of image information transmitted in serial form is short, because the storage time is only short.

An even smaller memory is sufficient if the respective instantaneous value of the sum of the currents of all the already driven elements on one supply line is stored. If the resistances between individual elements are the same and the drive starts at the remote end and the supply potential is fed at the near end of a row, only the sum of the previous currents need be stored in order to make it possible to calculate the potential on the supply line at the location of the next element to be driven. This drive process is dependent on signal retaining means being provided to keep the respective control signals for the elements with respect to the supply line. If one horizontal row is driven sequentially, element-by-element, from left to right, the remote end is on the left, and the near end is on the right.

One embodiment of the method for sequentially driving an illuminated display element-by-element provides for the values, which are held in the retaining means for each element in a row or column to be driven, to be erased before each drive process. In one embodiment, the erasure process is carried out by erasing the potentials which are stored in the signal retaining means or, in general, by storage of a suitable start value. If the start value is chosen appropriately, the current control means are not switched on, and no additional switching means are required to interrupt the current flow. The erasure process is in each case expediently carried out for an entire row or column, or for those elements in a row or column which are connected to a common supply line. The advantage mentioned above of a relatively small memory and of a short delay in the reproduction of the image contents which are transmitted in serial form pixel-by-pixel is also retained in this embodiment.

In one alternative embodiment of the sequential driving of an illuminated display element-by-element according to the invention, the stored image information of the respective preceding image is used in order to calculate the potential profile on a supply line. The old and the new image content, and thus the current, are known for each element which is connected to a supply line. The potential profile on the supply line is thus also known, or can be calculated. The control signal for each element to be driven is corrected on the basis of the known or calculated potential profile. The signal retaining means for the elements in this alternative do not need to be erased before being driven again. This embodiment is particularly suitable when image contents are transmitted sequentially, row-by-row. In this case, the respective valid image content is written sequentially to the illuminated display, row-by-row, in a similar way to that in the case of a cathode ray tube.

One embodiment of the illuminated display according to the invention has an associated memory, in which the image contents of rows, columns, fields or frames, or parts of them, are stored. This makes it possible to first of all calculate the potential profiles on a supply line and then to apply the corrected control signals to the elements. The reproduction of the stored image contents is delayed in a corresponding manner. The storage of the image contents means that they are also available for further calculations.

Figure 6:
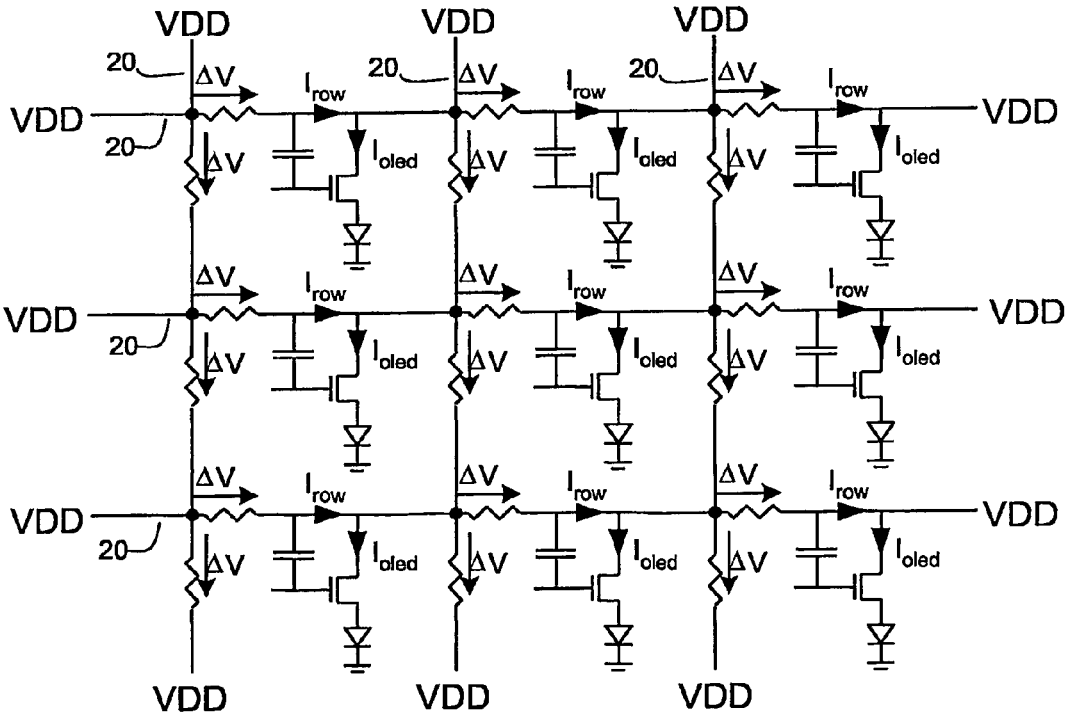
FIG. 6 shows a detail of an illuminated display with supply lines which are linked to one another.

The invention can also be used when the supply lines are connected to one another in the form of a network, as shown in FIG. 6. In this case, a series of linear equations must be solved, which can be produced in accordance with Kirchhoff's node and network rules. The correction values for the control signals for the individual elements are obtained from the solutions of the linear equations. In order to assist clarity, the currents and voltage differences are denoted in the same way in the figure. Obviously, the respective values may be different. In this embodiment, it is expedient for the image contents of all the elements which are connected via the supply lines to be known before the drive process. An appropriate memory is provided, for example, for this purpose.

Figure 7:
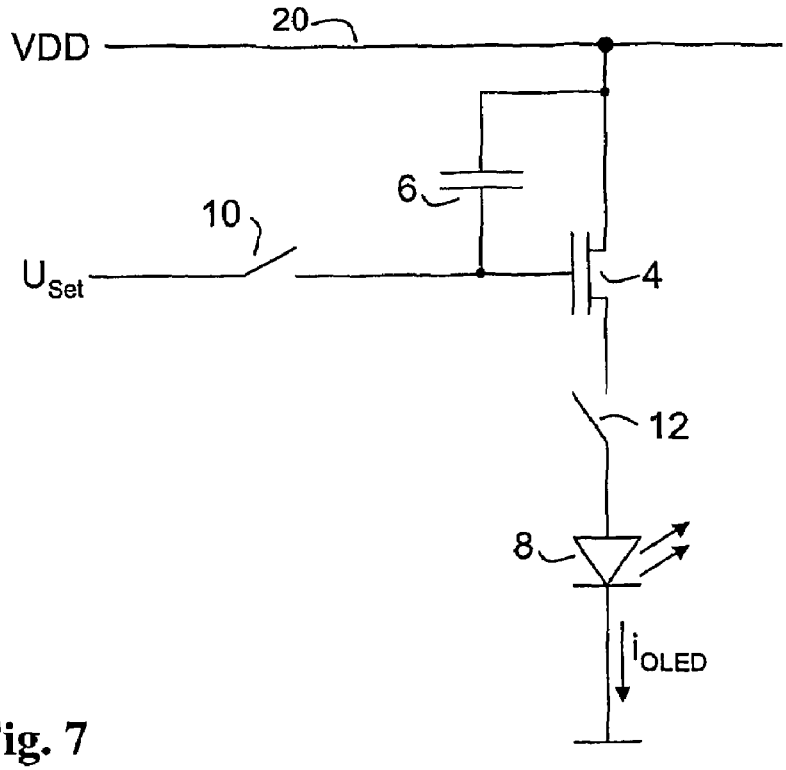
FIG. 7 shows a first exemplary embodiment of an element of an illuminated display according to the invention.

In one embodiment of the invention, the correction values or offset voltages are not explicitly numerically calculated. In this embodiment, the offset voltages are set automatically. One element 3 in an illuminated display according to this embodiment of the invention is illustrated in FIG. 7. The element 3 has a current control means 4 and a light emitting means 8. The control signal $U_{set}$ is applied to the control electrode of the current control means 4 via a first switching means 10. A signal retaining means 6 holds the control signal $U_{set}$ when the first switching means 10 interrupts the connection to a control circuit, which is not illustrated. The control signal is applied when no current is flowing in the supply line 20. A second switching means 12 is provided for this purpose, and interrupts the current path via the light emitting means 8 to ground. In this case, there are no potential differences on the supply line 20, and the nominal control signals are applied to the current control means 4. When the respective control signals have been supplied to all of the elements 3 which are connected to a common supply line, and the first switching means 10 has been opened, the second switching means 12 is closed. The current flow results in potential differences, in a known manner. The signal retaining means 6 holds the relative control signals with respect to the potential at the point at which the respective element 3 is connected to the supply line 20. An offset voltage sets itself with respect to the reference potential to which the nominal control signals are related. The signal retaining means 6 is formed, for example, by capacitors for a voltage drive. The capacitors in one preferred embodiment are integrated capacitors, which are also produced during the process of manufacturing the illuminated display.

One method according to the invention for driving an element as described with reference to FIG. 7 comprises a programming phase P1 and an operating phase P2. During the programming phase P1, the current flow through the light emitting means and through the elements 3 is interrupted, so that no steady-state potential difference exists on the supply line 20. At the end of the programming phase P1, the interruption of the current flow is cancelled, and the operating phase P2 starts. The desired current is now determined by the relative control signal, which is held in the signal retaining means 6 and is independent of potential fluctuations on the supply line 20, or follows them.

In another embodiment of the illuminated display according to the invention, no second switching means 12 is provided with the elements 3 in order to interrupt the current flow. By way of example, the elements 3 correspond to those in FIG. 2. A first connection of a light emitting means 8 is connected to a supply line 20 via a current control means 4. In contrast to FIG. 2, a second connection of the light emitting means 8 in the illuminated display according to the invention is not connected to ground or to a fixed reference potential, but is connected to a connecting network. The connecting network is at a variable potential. The current flow through the light emitting means can in this case be interrupted by appropriately varying the potential on the connecting network. In the case of the illuminated display according to the invention, the light emitting means 8 is, for example, switched to the reverse-biased direction by appropriately changing the potential on the connecting network, so that the current flow is interrupted. The potential in the connecting network can also be chosen such that the voltage across the light emitting means is low, and such that essentially no current flows through the light emitting means. The nominal control signals are then applied via the first switching means 10 to the signal retaining means 6 for the current control means 4. When the respective nominal control signals have been applied to the current control means 4 for all of the elements 3 which are connected to a common connecting network, the first switching means 10 is opened, and the potential on the connecting network is changed such that currents can flow through the current control means 4 and the light emitting means 8 corresponding to the control signals. The signal retaining means is in each case connected between the control inputs of the current control means 4 and the supply line 20 at the points to which the current-carrying connection of the elements is connected. The resultant potential differences on the supply line 20 thus have no adverse effect on the control potentials stored in the signal retaining means, and form the offset voltage with respect to the reference potential.

Figure 8:
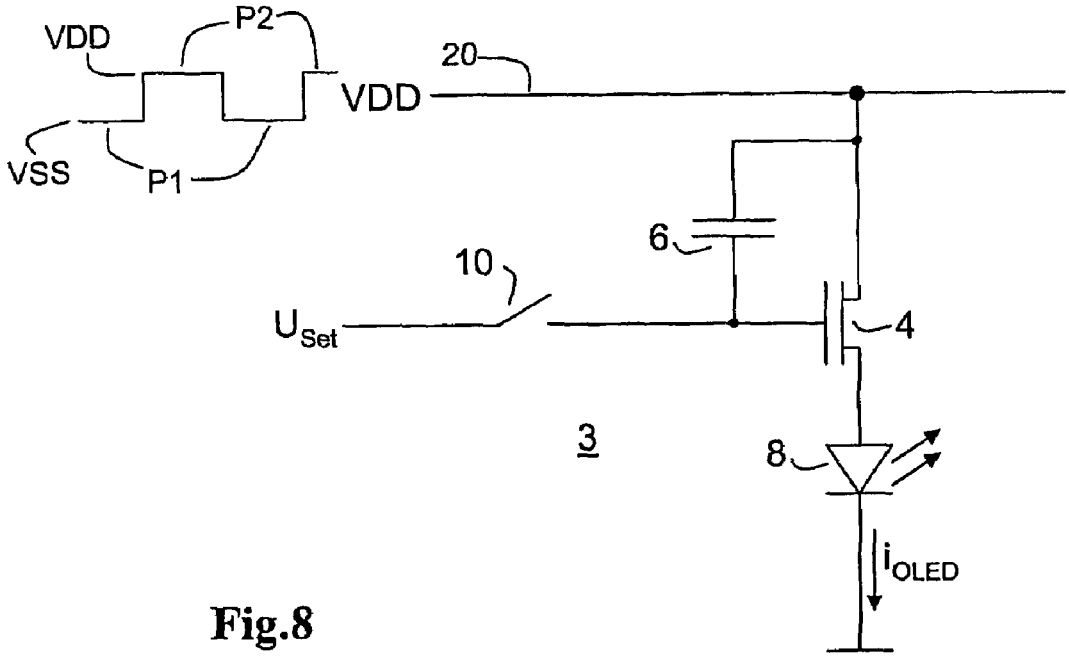
FIG. 8 shows an exemplary embodiment of the operation, according to the invention, of an element of an illuminated display.

FIG. 8 shows a further exemplary embodiment of a method for driving an element 3 in an illuminated display according to the invention. The potential on the supply line 20 for the illuminated display can be varied, for example, by switching it on and off. During the programming phase P1, a low potential, for example the reference potential or ground, is applied to the supply line 20. In the figure, the low potential is annotated VSS. Due to the low potential, no current can flow though the light emitting means. The nominal control signal is supplied to the signal retaining means 6 via the first switching means 10, which has now been closed. Once the control signals have been applied to the signal retaining means 6 for all of the elements 3 which are connected to a supply line 20, the first switching means 10 are opened again, and the supply line 20 is connected to a high potential, VDD in the figure. This corresponds to the operating phase P2. The potential is expediently chosen to be at least sufficiently high that the desired currents flow in all of the light emitting means 8. In the figure, the changing of the potential on the supply line 20 is indicated by the square-wave potential profile. The two phases P1 and P2 are identified in a corresponding manner.

One advantageous embodiment of the drive method according to the invention provides for driving row-by-row. In this case, only the image content of one row is ever changed at a time, while the image content of the other rows remains unchanged.

In one preferred embodiment of driving row-by-row, the image content of every alternate row is changed successively. The rows are subdivided into even-numbered rows and odd-numbered rows, depending on their position on the screen. Alternately, the image content of the even-numbered rows is changed first of all, followed by that of the odd-numbered rows. This simulates the known interlacing method.

In another embodiment of the drive method, the drive process is carried out frame by frame. In this case, the entire image content is programmed into the signal retaining means during the programming phase, after which the process switches to the operating phase.

The method according to the invention can be used, appropriately modified, for any desired illuminated displays. The nature of the arrangement of the elements in rows, columns or other groupings is intrinsically irrelevant for the method.

The image contents are expediently programmed in a time which is short in comparison to the active time during which the image contents are displayed.

Two or more elements 3 according to the invention in an illuminated display are arranged in the form of a matrix in a known manner, in one embodiment of the invention. They are driven row-by-row or column-by-column, and field-by-field or frame-by-frame. However, the drive process according to the invention can also be used for parts or groups of rows or columns, and for parts of fields or frames. In situations such as these, the elements in the illuminated display are connected appropriately and jointly to a supply line or to a connecting network.

The method according to the invention as well as the illuminated display according to the invention can be used particularly advantageously in televisions and monitors.

The invention claimed is:

1. A method of controlling elements in an illuminated display having multiple elements arranged in rows and columns, the method including, for each driving cycle, the steps of determining a nominal control potential to be applied to a control electrode of a current control means of an element with reference to a respective first reference potential, the first reference potential being the potential at a circuit node at which the element is connected to a power supply line, the nominal control potential corresponding to a control potential that is required for causing a current through the current control means and a light emitting means of the element to emit a desired amount of light when no voltage drop on the power supply line is present;

interrupting the current through the current control means of the elements connected to the same power supply line during applying the control potentials to the control electrodes of the current control means associated with the elements;

retaining the control potential in each individual element with reference to the corresponding first reference potential;

enabling the current through the current control means after the control potentials to all of the elements connected to the same power supply line have been applied, after re-establishing the current flow, increasing, continuously or in steps, the supply potential of the supply line, starting from a start value that is insufficient for causing the desired current flow through all of the elements;

measuring the current through the supply line while increasing the supply potential; and terminating increasing the supply potential when, in the event of a further increase of the supply potential, the change in the current through the supply line in steady state is below a predetermined value.

2. The method of claim 1, wherein the step of interrupting the current through the current control means of those elements connected to the same power supply line includes modifying the potential of the power supply line, to which those elements are connected, in such a way that a voltage across the light emitting means of the those elements is insufficient to cause a current flow, and wherein the step of enabling the current through the current control means of those elements connected to the same power supply line, to which those elements are connected, includes modifying the potential of the power supply line, to which those elements are connected, in such a way that the voltage across the light emitting means of the those elements is sufficient to cause a desired current flow.

3. The method of claim 1, further including the step of controlling switching means coupled in series with the light emitting means or the current control means, for interrupting the current through the current control means.

4. A method of controlling elements in an illuminated display having multiple elements arranged in rows and columns, each element having a current control means and a light emitting means arranged in series between a first and a second power supply line, the method including the steps of determining a nominal control potential to be applied to a control electrode of the current control means of an element with reference to a respective first reference potential, the first reference potential being the potential at a circuit node at which the current control means is connected to one of the first or second power supply line, the nominal control potential corresponding to a control potential that is required for causing the element to emit a desired amount of light when no voltage drop on the power supply line is present;

calculating the voltage drop along the power supply line that is supplying power to current control means of multiple elements, from the known resistance of the common power supply line between one end of the common power supply line, at which the common power supply line is connected to a power supply, and the position of a respective current control means of an element, as well as from the current that is flowing through the power supply line;

combining the nominal control potential and the calculated voltage drop to a single control potential that is referenced to a second reference potential, wherein the second reference potential is the same for multiple elements;

applying the single control potential to the control electrode of the current control means, for setting the current through the current control means;

dynamically, in accordance with image content reproduced by the display, determining a minimum required supply potential for each supply line from the calculated potential differences on the power supply lines and the currents through each of the elements connected to the supply line as well as from image content and information about electrical and electro-optical properties of the current control means and the light emitting means, respectively; and applying the calculated minimum required supply potential to the supply line.

5. A method of controlling elements in an illuminated display having multiple elements arranged in rows and columns, each element having a current control means and a light emitting means arranged in series between a first and a second power supply line, the method including the steps of determining a nominal control potential to be applied to a control electrode of a current control means of an element with reference to a respective first reference potential, the first reference potential being the potential at a circuit node at which the current control means is connected to one of the first or second power supply line, the nominal control potential corresponding to a control potential that is required for causing the element to emit a desired amount of light when no voltage drop on the power supply line is present;

interrupting the current through the light emitting means of all elements that are connected to common first and second supply lines prior to applying control potentials to individual elements;

calculating the voltage drop along the power supply line that is supplying power to multiple elements, from the known resistance of the common power supply line between one end of the common power supply line, at which the common power supply line is connected to a power supply, and the position of a respective element for which a control potential is to be set, as well as from the current that is flowing through the power supply line once at least one control potential is set and a corresponding current is flowing;

combining the nominal control potential and the calculated voltage drop to a single control potential that is referenced to a second reference potential, wherein the second reference potential is the same for multiple elements;

applying, one by one, the single control potential to the control electrode of the current control means, for setting the current through the current control means;

re-establishing the current through an element to which the corresponding single control potential has been applied, while maintaining the interruption of the current for those elements to which the corresponding single control potential has not yet been applied; and repeating the calculating, combining and applying steps until a corresponding single control potential has been applied to all elements that are connected to the common supply lines.

6. The method of claim 5, wherein the calculating, combining and applying steps are performed element-by-element beginning with an element that is farthest away from a point at which the shared supply lines are connected to a power supply.

7. The method of claim 6, wherein the calculating step includes determining the sum of the currents through those elements to which the corresponding single control potential has been applied, and through which the current has been re-established; and using the sum of the currents determined in the preceding step for calculating the voltage drop on the shared supply lines for an element to which no control potential has yet been applied.

8. The method of any one of claims 5-7, wherein, for interrupting the current, a control potential that does not result in a current flow is applied to the current control means.

9. The method of any one of claims 5-7 further including the step of controlling switching means coupled in series with the light emitting means or the current control means for interrupting the current through the light emitting means.

10. An illuminated display with a control circuit for controlling elements, which are arranged in a matrix arrangement, wherein the elements emit light when an electric current is applied, wherein multiple elements are connected to a common supply line, wherein the control circuit is disposed to perform the method of any one of claims 1-7.

11. A television set or monitor with an illuminated display according to claim 10.

* * * * *